US006670929B2

(12) United States Patent
Louzir et al.

(10) Patent No.: US 6,670,929 B2
(45) Date of Patent: Dec. 30, 2003

(54) COMPACT ANNULAR-SLOT ANTENNA

(75) Inventors: Ali Louzir, Rennes (FR); Françoise Le Bolzer, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 10/170,266

(22) Filed: Jun. 12, 2002

(65) Prior Publication Data

US 2003/0001790 A1 Jan. 2, 2003

(30) Foreign Application Priority Data

Jun. 22, 2001 (FR) ..... 01 08235

(51) Int. Cl.[7] ..... H01Q 13/12
(52) U.S. Cl. ..... 343/769; 343/767
(58) Field of Search ..... 343/700 MS, 746, 343/767, 768, 769

(56) References Cited

U.S. PATENT DOCUMENTS

| | | | | |
|---|---|---|---|---|
| 4,006,481 A | | 2/1977 | Young et al. | 343/770 |
| 4,987,421 A | * | 1/1991 | Sunahara et al. | 343/700 MS |
| 5,465,100 A | * | 11/1995 | Remondiere et al. | 343/769 |
| 5,714,961 A | * | 2/1998 | Kot et al. | 343/769 |
| 5,905,471 A | * | 5/1999 | Biebl et al. | 343/769 |
| 5,914,693 A | * | 6/1999 | Takei et al. | 343/767 |
| 5,995,058 A | | 11/1999 | Legay et al. | 343/789 |
| 6,329,950 B1 | * | 12/2001 | Harrell et al. | 343/700 MS |
| 6,452,560 B2 | * | 9/2002 | Kunysz | 343/770 |
| 6,509,880 B2 | * | 1/2003 | Sabet et al. | 343/770 |

FOREIGN PATENT DOCUMENTS

| | | | |
|---|---|---|---|
| EP | 0860893 A1 | 8/1998 | H01Q/5/00 |
| JP | 06255705 | 10/1994 | H01P/1/17 |

OTHER PUBLICATIONS 5995058 translation of 0860893 A1.
English Translation of 06255705.
C. Chen, N. Alexopoulos, Dept. of Elec. Eng. Unv. Of Calif. LA, Radiation by Aperture Antennas of Arbitrary Shape Fed by a Covered Microstrip Line, Publ. Date Jun. 18, 1995, pp. 2066–2069, USA.

* cited by examiner

*Primary Examiner*—Don Wong
*Assistant Examiner*—Shih-Chao Chen
(74) *Attorney, Agent, or Firm*—Joseph S. Tripoli; Brian J. Cromarty

(57) ABSTRACT

Planar antenna carried by a substrate comprising an annular slot, which is dimensioned to operate at a given frequency and which is fed via a line (2), such as a microstrip line, in a short-circuit plane of which the slot is situated. The annulus formed by this slot (1*a*), is deformed as indentations in at least one zone of the plane in which the electric field is a minimum for the given frequency and a given mode, this making it possible to obtain a lengthening of the slot perimeter with respect to an annular slot (1), of corresponding circular shape, without surface extension of the substrate zone wherein the slot is made.

7 Claims, 6 Drawing Sheets

COMPACT ANNULAR-SLOT ANTENNA

The invention relates to a planar antenna, with annular slot, exhibiting a compact shape which is more especially intended to be integrated into user terminals of mobile radio telephone networks. These networks may be accessible to the public or else be private networks and possibly domestic networks.

BACKGROUND OF THE INVENTION

The user terminals provided for such mobile radio networks are of ever smaller weight and bulk so as to satisfy the wishes of users who want to be able to carry them around easily on themselves or with themselves. The antennas provided for such terminals must therefore be of small size while yet offering high performance.

It is advantageous to integrate planar antennas made on supports of the printed circuit type into user terminals, since these supports exhibit a low profile. Under these conditions they are easily integrated into the analogue processing circuits required for the operation of the terminals and with which they exhibit a good degree of fit.

A known solution provides for the use of a planar antenna substrate which exhibits high permittivity making it possible to reduce the guided wavelength of the antenna and hence the size of the radiating element. This reduction in size is especially beneficial in the case where a terminal utilizes low frequencies, as is provided in respect of the terminals of existing networks and those currently under development and in particular in the case of GSM, WAP, GPRS, UMTS networks, etc.

However, the performance of small antennas made by utilizing such substrates with high permittivity may generally be regarded as insufficient on account of poor efficiency of structural origin and they are moreover relatively expensive.

SUMMARY OF THE INVENTION

The invention therefore proposes a novel planar antenna topology with annular slot making it possible to obtain an appreciable size reduction with a standard printed substrate which does not exhibit the drawbacks with regard to efficiency and cost which generally affect antennas made on a high-permittivity substrate.

The subject of the invention is therefore a planar antenna carried out by a substrate comprising an annular slot which is dimensioned to operate at a given frequency and which is fed via a feedline in a short-circuit plane of which it is situated.

According to a characteristic of the invention, the annulus formed by this slot, of annular shape, is deformed as indentations in at least one zone of the plane, where the electric field is a minimum for the given frequency and a given mode, so as to exhibit a lengthening of the slot perimeter with respect to an annular slot of corresponding circular form, without surface extension of the substrate zone wherein the slot is made.

According to a characteristic of the invention, the slot annulus is deformed as indentations, in at least one zone in which the electric field is a minimum, by a specified number of deformation elements and in particular by indentations relating to all or part of this zone.

BRIEF DESCRIPTION OF THE DRAWINGS

The invention, its characteristics and its advantages are specified in the description which follows in conjunction with the figures mentioned hereinbelow.

DESCRIPTION OF PREFERRED EMBODIMENTS

Figure 1:
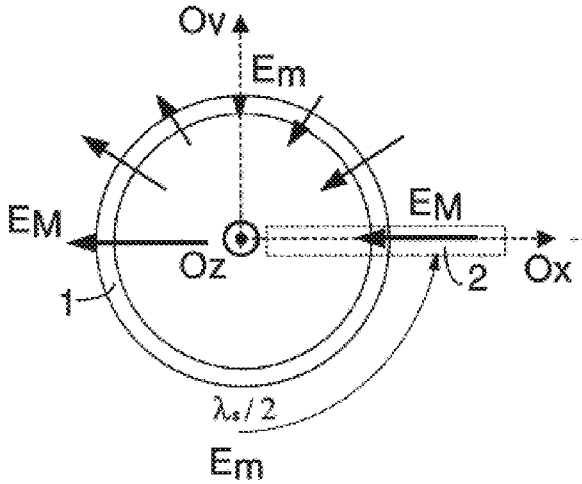
FIG. 1 PRIOR ART
FIG. 1 depicts a basic diagram relating to a known exemplary antenna including an annular slot of circular shape which is designed to operate in the fundamental mode and to be fed by a feedline in a short-circuit plane of which the slot is situated.

The known planar antenna depicted in FIG. 1 is assumed made on a substrate consisting of a standard printed circuit metallized on both its faces. An annular slot 1, of circular shape, is made, conventionally by etching, on the side intended to constitute the earth plane of the antenna. A feedline 2, represented dashed, is designed to feed the slot 1 with energy. Here it is assumed to consist of a microstrip line positioned on the other side of the substrate with respect to the slot 1 and oriented radially with respect to the circle formed by this slot, as illustrated.

In the embodiment envisaged, the microstrip line/annular slot transition of the antenna is produced in a known manner, so that the slot 1 lies in a line short-circuit plane, that is to say in a zone in which the currents are largest. The perimeter of the slot 1 is chosen to be equal to a multiple "m" of the wavelength to be guided, "m" being a positive integer number.

The resonant frequencies of the various modes are practically integer multiples of the frequency $f_o$, these modes corresponding in particular to the fundamental mode, to the first higher mode, etc.

The radiation patterns are determined by the distribution of the electric field in the slot and, as is known, they are chosen so as to satisfy the individual requirements of the intended applications.

The electric field of an antenna with annular slot of circular shape, assumed utilized in the fundamental mode and whose perimeter is chosen to be equal to the wavelength λs of the wave to be guided, is of maximum value $E_M$ at the crossover point X of the slot 1 and of the line 2 and at the diametrically opposite point, as shown diagrammatically by the long arrows in FIG. 1. This field is conversely of minimum value $E_m$, small or zero, at the two points of the slot which are diametrically opposite one another in relation to a diameter which is perpendicular to the diameter joining the two points where the field is a maximum, this minimum field is shown diagrammatically by a short arrow for the point located at the top of the figure.

According to the invention, there is provision to deform the annulus formed by the slot of an antenna in such a way as to lengthen the perimeter thereof while reducing the area occupied by the antenna on the substrate. Such a reduction can be utilized to make it possible to position annular slots in one and the same substrate zone and for example two slots of different sizes which operate with one and the same frequency and each for a different mode. An antenna having a slot of a given, relatively small perimeter may be designed, for example, for a fundamental mode, an antenna having a larger specified perimeter, then being designed, for example for the first higher mode. The two slots may then be made at the level of one and the same zone of the substrate which carries them and where one lies inside the other.

Given that an antenna is designed so as to exhibit characteristics which are determined in particular as regards radiation, there is preferably provision to effect a deformation which creates not significant distortion of the radiation pattern of the deformed antenna relative to the pattern of a comparable antenna, with annular slot of circular shape.

Figure 2:
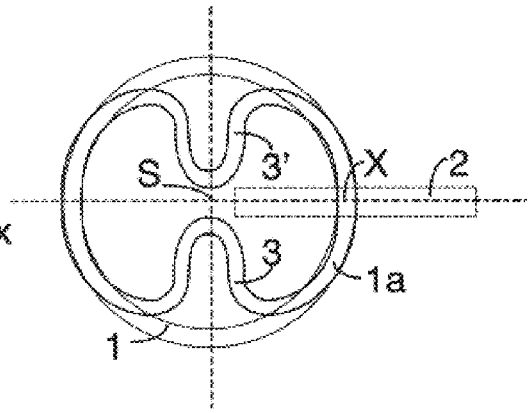
FIG. 2 depicts a first exemplary antenna with annular slot, deformed according to the invention, which is designed to operate in the fundamental mode.

An exemplary deformation of an annular slot operating at the same frequency and according to the same mode as the annular slot depicted in FIG. 1 is illustrated in FIG. 2. This deformation is produced taking account of the fact that the electric field is zero or very small in certain zones of the slot, here the so-called zones where the electric field is a minimum. It is therefore possible to deform the slot in these zones by creating one or more deformation elements therein, for example one or more indentations, so as to obtain a lengthening of the slot, without any harmful consequence for the operation of the antenna of which this slot constitutes the radiating element.

In the example illustrated in FIG. 2, the deformed annular slot 1*a* is inscribed within the substrate zone designed for an annular slot of circular shape 1, for which it is substituted. This deformed annular slot 1*a* is designed to be able to be fed with energy by a feedline 2, under the same conditions as for the annular slot 1, the two slots 1 and 1*a* being assumed designed for one and the same frequency, for example of the order of 2.4 GHz and for one and the same mode, here the fundamental mode. The deformation produced pertains to the two zones of minimum electric field which were defined above, it is manifested as two indentations made symmetrically, on the one hand, along the diameter of the slot which links the points at which the electric field is a maximum in this slot configuration, one of these points being the slot excitation point X situated at the crossover of the slot 1*a* and of its feedline 2, and, on the other hand, along a slot diameter which is perpendicular to the previous one.

More generally, the annulus of a slot, according to the invention, is made in such a way as to be symmetrically deformed as indentations with respect to a central point S in an even number of zones in which the electric field is a minimum for a given frequency and a given mode.

In the case of an annular slot 1, of circular shape, designed to operate in the fundamental mode at 2.4 GHz, the area exhibited by the slot can be delimited by a circle of radius 16.4 mm. A corresponding deformed annular slot, assumed symmetric with respect to the point S constituting its centre of symmetry, will be inscribed within the circle of radius 16.4 mm to which it will be tangential in the diametrically opposite zones where the electric field is a maximum, whereas by contrast the dimension of the slot along a diameter perpendicular to the previous one may be greatly decreased, as shown diagrammatically by the two indentations 3, 3'.

Figure 3:
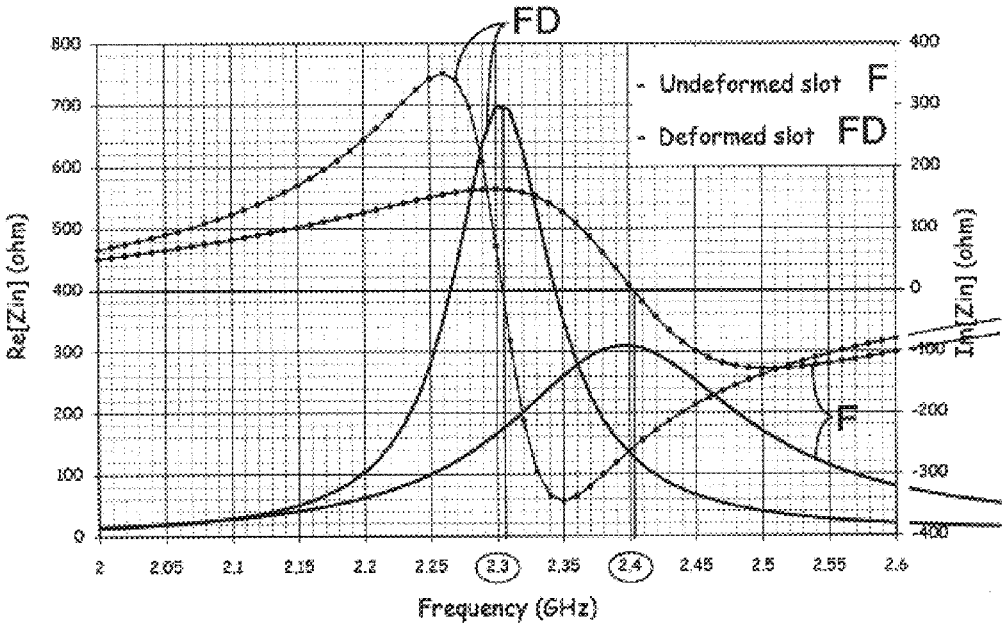
FIG. 3 depicts a set of curves showing the influence of the slot deformation carried out for an antenna according to FIG. 2 on the input impedance relative to a conventional antenna according to FIG. 1.
Figure 4:
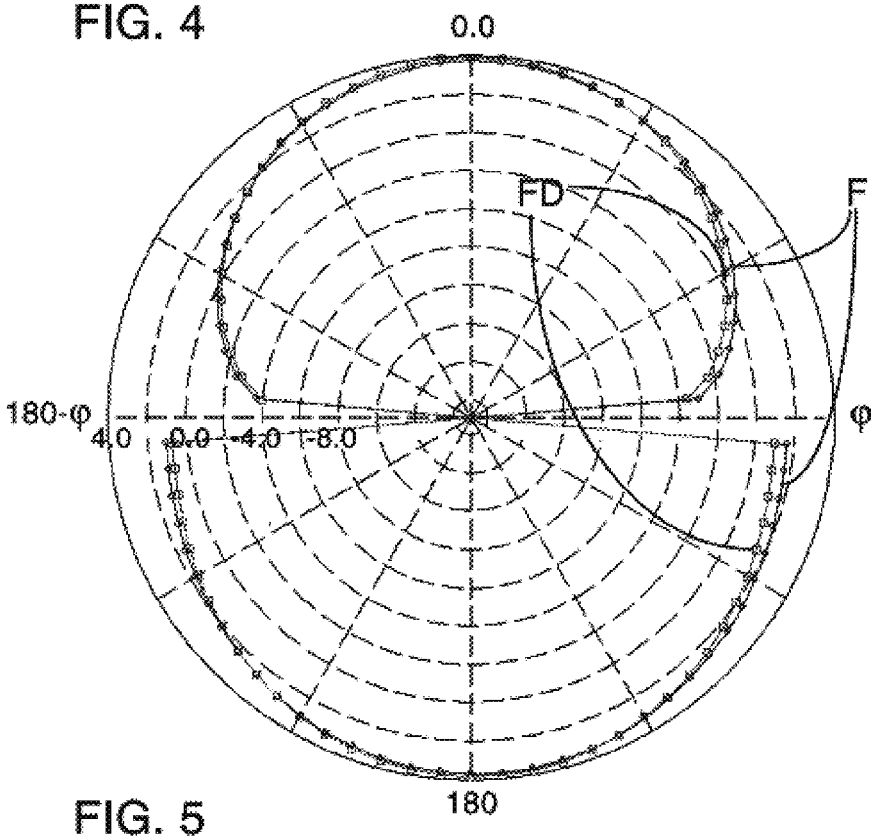
FIGS. 4 and 5 depict two sets of curves illustrating the influence of the slot deformation carried out for an antenna according to FIG. 2 on the COE and COH directivity patterns, in the xOz and yOz planes of the reference trihedron, relative to an antenna according to FIG. 1.
Figure 5:
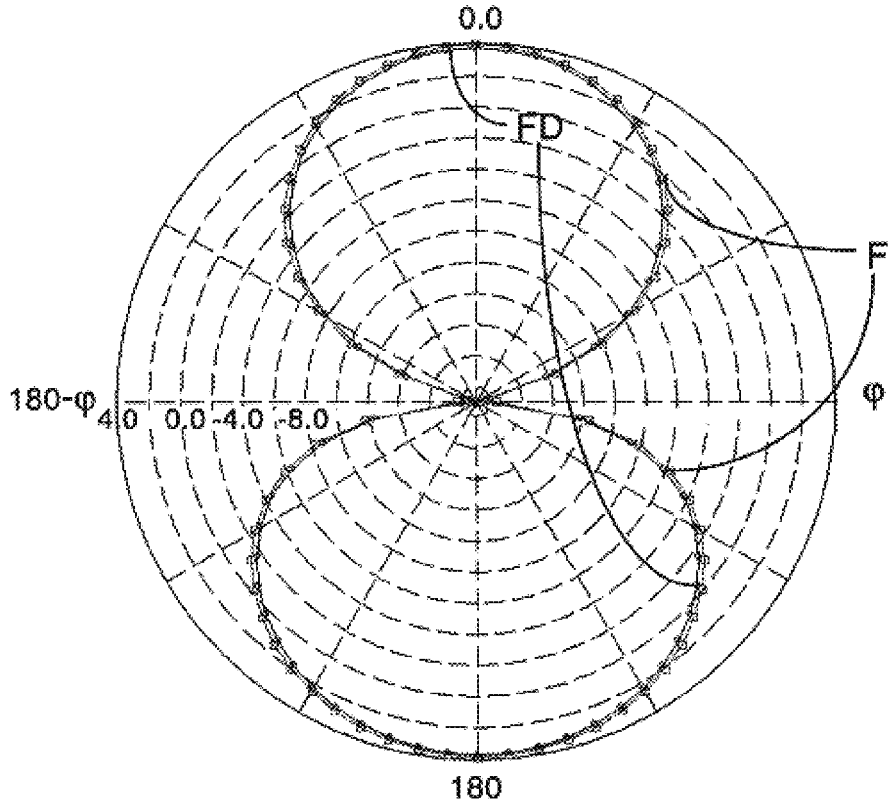

A simulation of the two antenna structures illustrated in FIGS. 1 and 2 makes it possible to verify that such a deformation permits a slot lengthening with no significant drawback, as shown by FIGS. 3, 4 and 5.

FIG. 3 demonstrates the influence of the annular slot deformation envisaged hereinabove on the input impedance of the antenna which this slot comprises. The input impedance "Zin" of the deformed slot illustrated in FIG. 2 is given by the two curves referenced FD which correspond, one to the variation of the imaginary part of this slot impedance and the other to that of the real part, as a function of frequency. The scales in ohms relating to the real part and to the imaginary part are depicted therein respectively, the first named on the left and the other on the right of the chart and the same holds for the two curves referenced F produced for the undeformed slot illustrated in FIG. 1. It is clearly apparent on examining the curves F and FD that there is a shift towards the low frequencies of the point at which the imaginary part of the input impedance of the deformed slot goes through zero. This shift is equivalent to a reduction in the resonant frequency of the slot which goes from 2.4 GHz for the annular slot of circular shape to 2.3 GHz for the deformed annular slot.

By contrast, FIGS. 4 and 5 featuring the directivity patterns referenced F and FD relating respectively to the slot illustrated in FIG. 1 and to that illustrated in FIG. 2 show the little consequence of the slot deformation in relation to these patterns.

The component E-theta in the plane phi equals zero degrees corresponds to the copolar pattern in the E plane (COE) represented in FIG. 4. The component E-phi in the plane ϕ equals ninety degrees corresponds to the copolar pattern in the H plane (COH) illustrated in FIG. 5. The elevational representations of the COE and COH antenna directivity are obtained with a frequency of 2.4 GHz in the case of the antenna with annular slot, of circular shape, such as envisaged hereinabove and shown diagrammatically in FIG. 1, and with a frequency of 2.3 GHz in the case of the antenna with deformed annular slot, according to FIG. 2.

Figure 6:
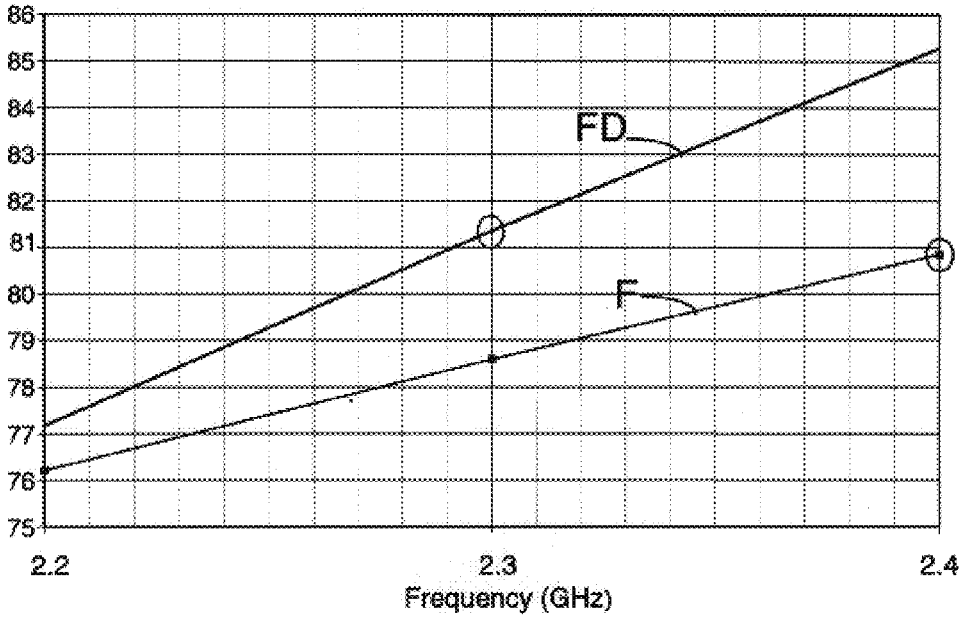
FIG. 6 depicts a set of two curves illustrating the influence of the slot deformation as regards efficacy of radiation for an antenna according to FIG. 2, relative to an antenna according to FIG. 1.

The efficacy of radiation of the antenna with deformed annular slot is equivalent to that of the antenna with annular slot of circular shape, as shown by the curves F and FD in the chart of FIG. 6 in which the frequency is plotted along the abscissa and in which the efficacy of radiation, graduated in %, is plotted along the ordinate. It is apparent, with no ambiguity, that the two antennas have practically the same efficacy of radiation, of the order of 81% when the frequency of the guided wave is 2.4 GHz, for the antenna with annular slot of circular shape and for a lower frequency of 2.3 GHz for the antenna with deformed annular slot. This shows the advantage afforded by the lengthening of the perimeter of the deformed annular slot which makes it possible to utilize a frequency of guided wave over a smaller substrate area than that required for the installation of an antenna with annular slot of circular shape operating at the same frequency and in the same mode.

FIG. 3 which illustrates the variation in the input impedance of the two annular slots as a function of frequency, shows that the impedance of the deformed annular slot for a given frequency differs from that of the annular slot of circular shape, both as regards its imaginary part and its real part, with a shift towards the low frequencies for the maximum values relating to the deformed annular slot. These maximum values are moreover greater than those obtained for the annular slot of circular shape. A significant increase in the real part of the input impedance is noted, it may reach high values, of the order of 700 ohms in the fundamental mode and this would constitute a drawback as regards matching, if it were not possible to vary the input impedance of the deformed annular slot.

According to the invention, a variation of this input impedance is obtained by shifting the feed plane of the deformed slot, this shift corresponding to a displacement of the slot with respect to the feedline in such a way that the feed plane of this slot is made to coincide with a plane for which the impedance is lower. This is therefore manifested as a modification of the position of the slot excitation point X along the slot.

Figures 7A, 7B, 7C:
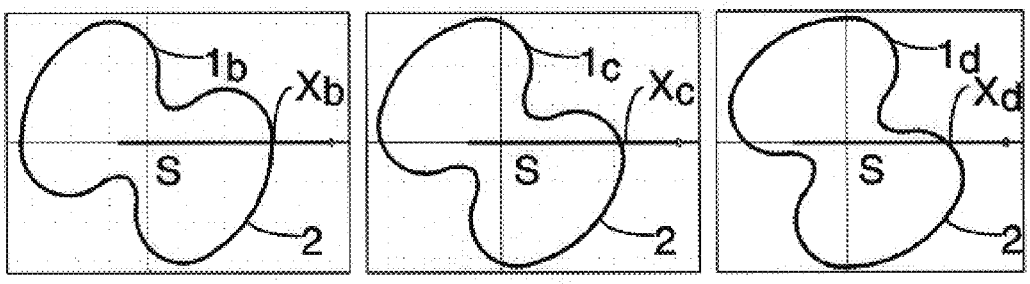
FIGS. 7A, 7B, 7C depict three diagrams relating to variant orientations of a deformed annular slot which are designed to operate in the fundamental mode.

As illustrated in FIGS. 7A, 7B, 7C, there is provision to rotate the deformed slot about its centre of symmetry S, with respect to the feedline and in a plane on the substrate which comprises it.

The rotations provided for here are 30 degrees with respect to the position illustrated in FIG. 1, in the case of the slot 1*b* depicted in FIG. 7A and 45 and 60 degrees respectively in the case of the slots 1*c* and 1*d* depicted in FIGS. 7B and 7C. They lead to the obtaining of three different positions Xb, Xc, Xd of the slot excitation point along the slots which differ through their respective orientations, in relation to the lines which feed them on their respective substrates.

Figure 8:
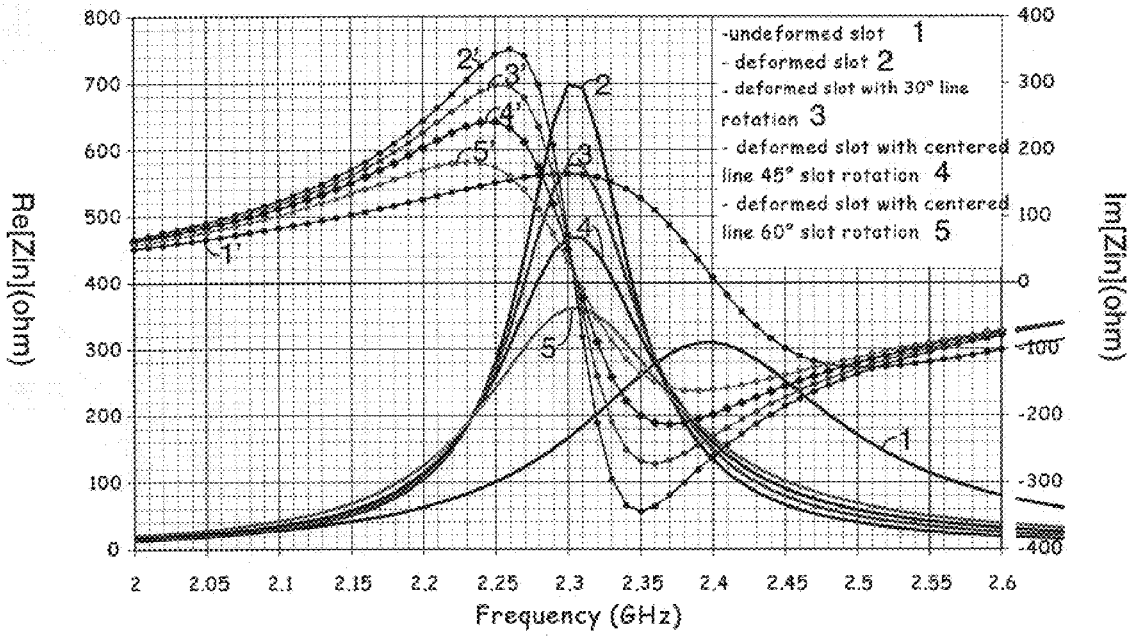
FIG. 8 depicts a set of curves showing the influence of the orientation of a deformed annular slot on the input impedance of this antenna, in the various cases envisaged earlier.

The set of curves depicted in FIG. 8 shows that the rotation imposed on the deformed slot causes a reduction in its input impedance and more especially in the real part of this impedance.

The curves referenced 1 and 1' correspond respectively to the real part and to the imaginary part of the input impedance of an annular slot of circular shape as envisaged in FIG. 1. The curves referenced 2 and 2' correspond respectively to the real part and to the imaginary part of the input impedance of the deformed annular slot depicted in FIG. 2. The curves respectively referenced 3 and 3', 4 and 4', 5 and 5' correspond to the respective real and imaginary parts of the deformed and shifted slots which are illustrated in FIGS. 7A, 7B and 7C. It is clearly apparent that the amplitude of the variation of these parts, both real and imaginary, of the input impedance, as a function of the guided wave frequency decreases as the slot rotation angle increases and that impedance matching can be obtained by selecting a specified value for this angle, under given frequency and mode conditions.

According to the invention, there is also provision to produce a deformation of an annular slot intended to operate at a given frequency in such a way as to allow it to occupy an even smaller substrate zone than that envisaged hereinabove, when there is provision to operate this deformed slot in a higher mode than the fundamental mode. A saving in area which is substantially greater than the saving obtained with the deformed annular slots envisaged in conjunction with FIGS. 1 to 8 can be obtained, the saving in area expected with these slots intended to operate in the fundamental mode being of the order of 10%.

Figure 9:
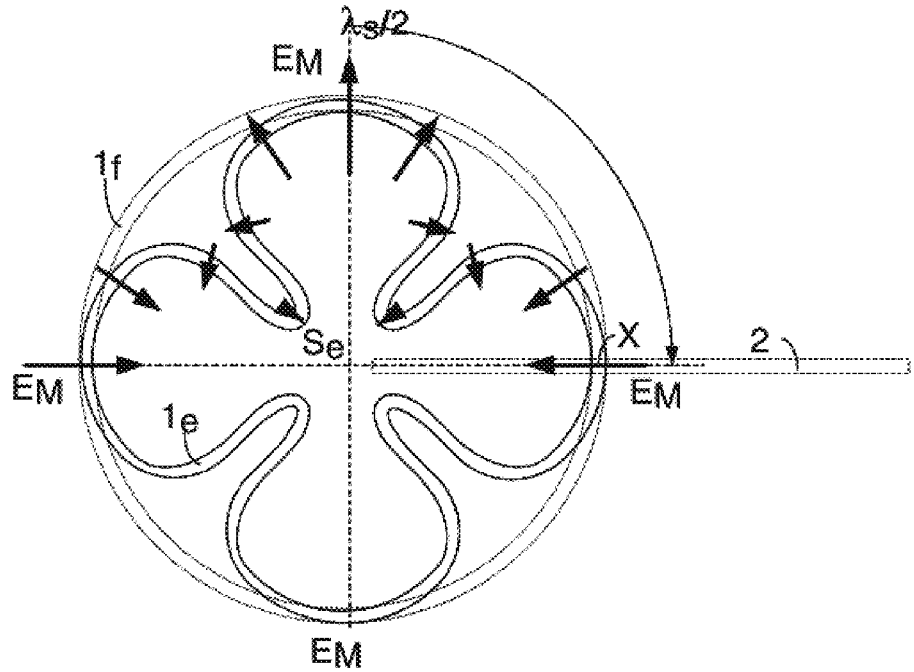
FIG. 9 depicts a basic diagram relating to a variant slot deformation intended for a deformed annular-slot antenna assumed designed to operate according to a first higher mode.

FIG. 9 depicts an example, nonlimiting, of a deformed slot 1*e* designed to operate at the first higher mode, at a frequency corresponding to that envisaged for an annular slot of circular shape referenced 1*f*.

According to the principle defined above, there is provision to make a deformed slot whose perimeter is equal to twice the wavelength $\lambda s$ of the wave to be guided. The lengthening is obtained by deforming the slot with respect to the corresponding circular-shaped annular slot 1*f*, by utilizing the fact that the electric field varies periodically along a slot annulus and that it is zero or very small in certain zones and a maximum in others. In the case depicted in FIG. 9, the electric field is of maximum value $E_M$, on the one hand, at the level of the crossover point X of the slot 1*e* and of the line 2, and of the diametrically opposite point of this slot, on the other hand, at the level of the two points which are diametrically opposite one another along a diameter which is perpendicular to the diameter joining the two aligned points considered previously at which the field is a maximum. This therefore corresponds to an angular variation of periodicity equal to 90 degrees about the central point Se which constitutes the centre of symmetry S of the slot annulus. The electric field is by contrast of minimum value for four points disposed periodically at 90 degrees to one another, starting from a first of them disposed at 30 degrees with respect to the crossover point of the slot and of the feedline, in FIG. 9. A representation of the variation in the electric field in the case of the slot 1*e* is given by a set of arrows whose length symbolizes the value of the field.

The deformation produced at the level of the deformed annular slot 1*e* pertains to the four zones of minimum electric field defined hereinabove, it is manifested as four deformation elements each consisting of an indentation, these indentations being produced symmetrically pairwise with respect to the central point Se.

Figure 10:
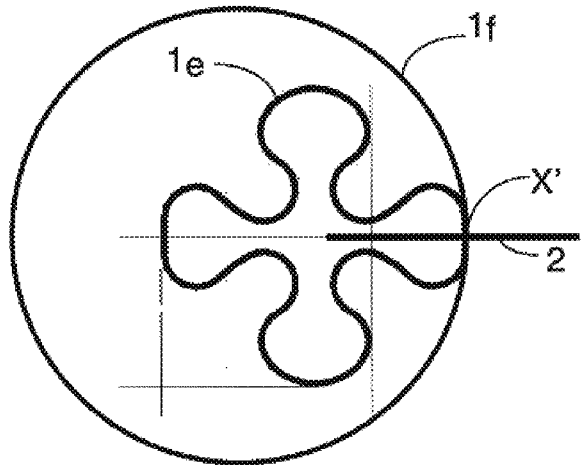
FIG. 10 depicts a comparative diagram showing the reduction in surface area obtained with a deformed annular-slot antenna, as depicted in FIG. 9, relative to a conventional annular-slot antenna operating under the same frequency and mode conditions.

FIG. 10 illustrates the respective sizes of a slot with circular annulus 1*f* and of the deformed slot 1*e* envisaged hereinabove operating at the first higher mode and at one and the same frequency, for example of the order of 4.8 GHz, it shows the space saving obtained which is nearly 60%, in this case.

Figure 11:
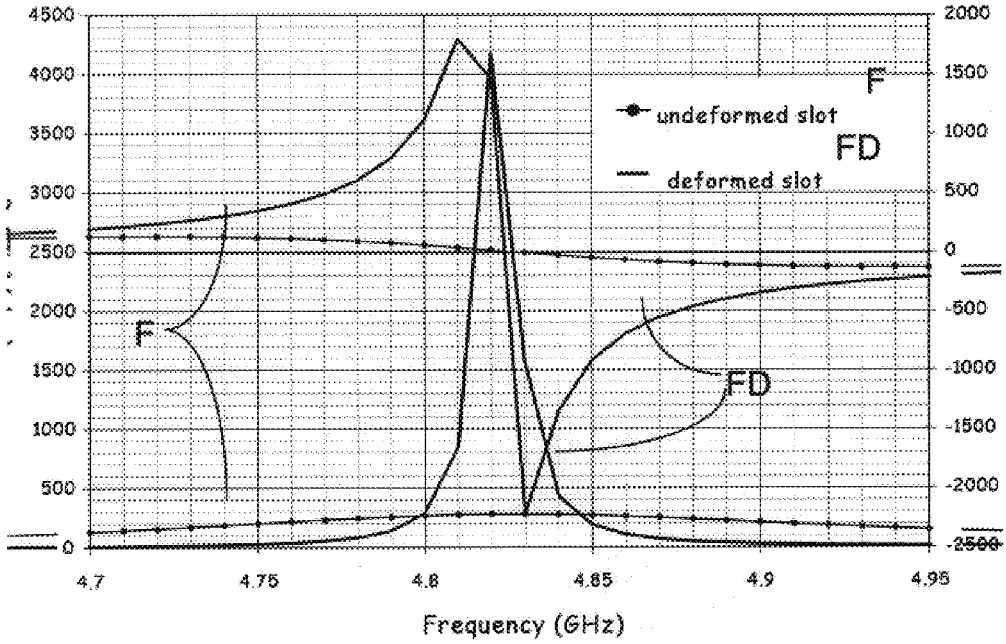
FIG. 11 depicts a set of curves representative of the input impedances of the two annular-slot antennas, depicted in FIGS. 1 and 9 respectively, within the framework of operation according to a first higher mode.

FIG. 11 demonstrates the influence of the annular slot deformation, as provided for at the level of the deformed annular slot 1*e* on the input impedance of the antenna which comprises this slot.

The input impedance of the deformed slot 1*e* illustrated in FIG. 10 is given by the two curves referenced FD which correspond, the one to the variation in the imaginary part of this slot impedance and the other to that of the real part, as a function of frequency, the scales in ohms relating to the real part and to the imaginary part being respectively depicted, the first named on the left and the other on the right of the chart. The same holds for the two curves referenced F produced for the undeformed slot 1*e*. A relatively large increase in the input impedance of the deformed annular slot 1*e* relative to the annular slot of circular shape 1*f* is apparent on examining the curves F and FD depicted in FIG. 10. Just as earlier, there is provision to reduce this input impedance by modifying the location of the slot excitation point, as described above in conjunction with FIG. 7 in the case of the deformed annular slot operating in the fundamental mode.

As in the case of the deformed annular slot 1*a*, the deformed annular slot, 1*e*, has no great influence with regard to the COE and COH directivity patterns which, consequently, are not portrayed here.

It has been assumed here that the slot feed was produced by means of a microstrip line, it may of course be constructed differently, for example via a coaxial link, as known.

What is claimed is:

1. Planar antenna carried by a substrate comprising an annular slot, dimensioned to operate at a given frequency, which is fed via a feedline in a short-circuit plane of which it is situated, wherein the annulus formed by said slot, of annular shape, is deformed as indentations in at least one zone of the plane, where the electric field is a minimum for the given frequency and a given mode, so as to exhibit a lengthening of the slot perimeter with respect to an annular slot of corresponding circular form, without surface extension of the substrate zone wherein the slot extends.

2. Antenna according to claim 1, wherein the slot annulus which it comprises is deformed as indentations, in at least one zone in which the electric field is a minimum, by a specified number of deformation elements relating to all or part of this zone.

3. Antenna according to claim 2, wherein at it comprises an annular slot whose annulus is symmetrically deformed as indentations with respect to a central point in an even number of zones in which the electric field is a minimum for a given frequency and a given mode.

4. Antenna according to claim 1 wherein it comprises a slot excitation point, situated at the crossover point of the slot and of the feedline and which is placed on an axis of symmetry of the slot annulus connecting this crossover point to another point at which the electric field is a maximum for a given frequency and a given mode.

5. Antenna according to claim 1 wherein it comprises a slot excitation point, situated at the crossover point of the slot and of the feedline and which is shifted along the slot with respect to the points of the slot which are situated on an axis of symmetry of this slot.

6. Antenna according to claim 1, wherein it comprises a slot, intended to operate at a given frequency and in fundamental mode, whose annulus comprises two indentations symmetrically disposed on either side of an axis of the annulus situated between them.

7. Antenna according to claim 1, wherein it comprises a slot, intended to operate at a given frequency and at a first higher mode, whose annulus comprises four indentations symmetrically disposed with respect to a central point of this annulus.

* * * * *